United States Patent [19]

Broussard

[11] Patent Number: 4,470,488

[45] Date of Patent: Sep. 11, 1984

[54] CARRYING CASE FOR HEALTH PROGRAM

[76] Inventor: Alphe Broussard, 64 Avenue Mohamed Diouri, Kenitra, Morocco

[21] Appl. No.: 482,560

[22] Filed: Apr. 6, 1983

[51] Int. Cl.[3] ..... A47B 97/00; A47B 81/00

[52] U.S. Cl. ..... 190/16; 220/23; 206/1.7; 206/1.8

[58] Field of Search ..... 190/16; 206/1.7, 1.8, 206/232; 220/22, 23; 150/1.6; 312/230, 231, 233, 244, 283

[56] References Cited

U.S. PATENT DOCUMENTS

| | | | |
|---|---|---|---|
| 1,128,542 | 2/1915 | Steinthal . | |
| 1,973,283 | 9/1934 | Buttrick | 190/51 |
| 2,511,774 | 6/1950 | Goldsmith | 273/136 |
| 2,609,073 | 9/1952 | McLaughlin | 190/11 |
| 2,614,397 | 10/1952 | Petty | 220/23 X |
| 2,685,363 | 8/1954 | Falk et al. | 220/23 X |
| 2,733,113 | 1/1956 | Humbargar | 312/251 |
| 2,867,928 | 1/1959 | Angell | 206/1.8 |
| 3,311,202 | 3/1967 | Schell et al. | 190/16 |
| 3,527,514 | 10/1968 | Jefferson | 312/234 |
| 3,680,750 | 8/1972 | Franco | 224/5 |
| 4,061,224 | 12/1977 | Fuhri | 220/22 X |
| 4,106,597 | 8/1978 | Shook et al. | 190/43 |
| 4,209,085 | 6/1980 | Kozan | 190/51 |
| 4,372,630 | 2/1983 | Fuhri | 206/1.7 X |

FOREIGN PATENT DOCUMENTS 509285 8/1939 United Kingdom .

*Primary Examiner*—Steven M. Pollard
*Attorney, Agent, or Firm*—Fisher, Christen & Sabol

[57] ABSTRACT

Portable case for such things as a health program. The case includes a bottom housing having a bottom, a back wall, two side walls and a front wall. The front wall has an aperture in the lower part thereof sufficient in size to allow the insertion into or removal therefrom of at least one book from the interior of the bottom housing. There is a top housing having a top, a back wall, two side walls and a front wall. The bottom edge of the back wall of the top housing is hinged to the top edge of the back wall of the bottom housing. The front wall of the top housing is enlarged so that it covers the front portion of the top housing and at least the aperture of the bottom housing. There is a flat lid which is hinged on its back edge to the top edge region of the back wall of the bottom housing of the bottom compartment. The flat lid covers the tray formed by the horizontal wall when in the down position and is in a nearly vertical position when in the raised position. The flat lid is magnetized so that metal items can be attached thereto for display or similar purposes.

5 Claims, 4 Drawing Figures

CARRYING CASE FOR HEALTH PROGRAM

BACKGROUND OF THE INVENTION

This invention is related to portable or carrying cases. This invention also is related to health programs for individuals and families.

BROAD DESCRIPTION OF THE INVENTION

An object of this invention is to provide a manually portable or carrying case of the briefcase type. Another object of this invention is to provide such a case that can be used to display items used in a health program for individuals and families. A further object of this invention is to provide a method of using such case in a health program for individuals and families.

This invention involves a portable case for such things as a health program. The portable case includes a bottom housing having a bottom, a back wall, two side walls and a front wall. The front wall has an aperture in the lower part thereof sufficient in size to allow the insertion into or removal therefrom of at least one book from the interior of the bottom housing. Preferably there is room for three books across. There is a top housing having a top, a back wall, two side walls and a front wall. The bottom edge of the back wall of the top housing is hinged to the top edge of the back wall of the bottom housing. The front wall of the top housing is enlarged so that it covers the front portion of the top housing and at least the aperture of the bottom housing. The top edge of the front wall of the top housing is hinged to the front edge of the top of the top housing so that the top housing can be raised to a nearly vertical position when the bottom housing is in a horizontal position. A vertical wall is positioned crosswise in the back portion of the bottom housing. The vertical wall forms a compartment in the back portion of the bottom housing. A horizontal wall is positioned in the front portion of the bottom housing and it contacts vertical wall and the front wall of the bottom housing so as to form a shallow tray in which elongated narrow metal strips can be stored. There is a flat lid which is hinged on its back edge to the top edge region of the back wall of the bottom housing of the bottom compartment. The flat lid covers the tray formed by the horizontal wall when in the down position and is in a nearly vertical position when in the raised position. The flat lid is mangetized so that items can be attached thereto for display or similar purposes.

Preferably a handle is mounted on the outside surface of the front wall of the top housing. Preferably at least one latch is positioned on the front wall of the top housing to affix it to the bottom housing. Also, preferably one or more compartments are positioned in the top housing so that the compartments are in a vertical position when the top compartment is in the raised position.

This invention also includes the method of using the portable case of the invention for conducting a health program which includes displaying mineral and vitamin information and data for dialy health needs and/or disease prevention and/or alleviation purposes by placing the metal strips containing such data on the magnetized lid.

This invention, typically, uses the indexing of three publications for the prevention of common diseases which will facilitate and encourage individuals and families to read, digest and apply the principles and techniques necessary to insure individual good general health by good nutrition, thereby up-dating the health of the nation. With the invention device and process, the learning of prevention of diseases, even before the symptoms appear, and of care of personal health is developed gradually and relentlessly throughout the life of a person as a hobby, instead of the usual wait until struck by illness and then attempt to cure the disease syndrome as presently practiced. It is most gratifying and reassuring to realize that the human body, given the necessary vitamins, minerals, exercises, fresh air, proper liquids, rest and a continual wholesome ration of thoughts can, in most cases, rebuild the wear and tear or its elements and with an effective defense mechanism can guard against the routine attacks by viruses, bacterias, infections and even the too frequent necessity of medical intervention. To wit, no one is more qualified than the defense mechanism to maintain good general health. The savings in peace of mind, aches and money, to oneself, to one's family, to one's employer, and to the solvency of the health organizations financing the health programs of the nation, after having fulfilled one's own indispensible responsibilities, are infinite.

This invention relates to a specially designed brief case in which is compacted the indexing mechanism to organize the application of disease prevention techniques through knowledge and better nutrition. The referenced publications preferably are (1) The Encyclopedia Of Common Diseases, Staff of Prevention Magazine, Rodale Press, (1982).

(2) The Complete Book Of Vitamins, Staff Of Prevention Magazine, Rodale Press, (1977).

(3) The Complete Book Of Minerals For Health, Sharon Faelton et al., Rodale Press, (1981).

The indexing mechanism consists of a brief Index Card System for each disease, indicating the symptons, the food normally providing the vitamins and minerals required for the prevention and possible cure of such diseases and the pertinent chapters of the prevention publications explaining the various aspects of the common diseases in question. Also included are index cards showing first aid remedies for various health hazards which may be encountered and a file card system showing recipes of the most nutritious meals to prevent certain vitamin and mineral deficiencies which eventually lead to bad health and disease.

In the metal strip storage area are metal bars showing the headings of various information, vitamins and minerals with growth items marked by a star to accommodate mothers of growing children. Some metal strips show the vitamins and minerals required by age and sex to maintain good general health for persons in good health. Some metal strips show various foods and the vitamins and minerals which can reasonably be expected in such foods. Some metal strips show the composition of the various well balanced formulas of vitamins and minerals supplements. Some metal bars show the vitamins and minerals needed for the prevention and the possible cure of certain disease. Some metal bars show certain life styles which are detrimental to good general health if not eliminated and other metal bars show certain life styles which will induce good general health.

An object of this invention is to induce every individual of this country, or the people of the world at that, to gradually but relentlessly develop their knowledge of the important task of taking care of their health. Another object of this invention is to compound the health improvements of the people of this nation in the interest of enhancing the solvency of health care organizations. A still further object is to bring to light the responsibility of every individual to practice the principles and techniques which reduce human suffering as a result of illness, the massive loss of productive man hours through illness, and the disabling blows which bad health imposes on the productivity of any conceivable type of work endeavor.

This invention for individuals was created to inform, encourage, simplify and organize the technology of such a complex endeavor as the care of personal health and the prevention and possible cure of common diseases. The beneficaries commencing with every individual willingly or induced to participate effectively in this massive undertaking of cultivating good general health will mushroom through all layers of management to the top of the government of this nation. Even physicians, dentists and the various types of hospital accommodations will benefit by employing their knowledge and facilities to curing the real sick patients since there will be far less presumably sick to consume their time and facilities.

The net gains of this invention will be better nutrition, well being, good general health, less medications, less aches and peace of mind.

This invention, depending upon the extent of efforts diligently applied in the arts of providing required nutrients to the body, the arts of eliminating life style which are detrimental to good general health, and the arts of adopting life style which are inductive to good general health, all of which can be learned in the teachings of the indexed publications to be grasped expeditiously or progressively throughout the life of an individual as required, helps one to improve or cure oneself of the following examples of sickness or symptoms in various degrees:

(a) Can be used to reduce cholesterol, triglycerides, uric acid, blood pressure, pulse rate, overweight and underweight.

(b) Can be used by its teachings to induce an individual of the soundness of reducing or eliminating smoking and the drinking of alcohol, to curtail or eliminate the eating of all sorts of refined foods and soft drinks which generally create sicknesses which imposes their aches, discomfort and expenses on one.

(c) Can be used to eliminate most eye problems such as diminishing eyesight, itching, burning, watering, aching, tiredness and headaches.

(d) Can be used to improve one's sense of smell, taste, touch and hearing.

(e) Can be used to prevent mental disturbances such as anxiety, stress, confusion, forgetfulness, senility, memory laps, near depression and pessimism.

(f) Can be used to cure or render inoffensive such aches as bursitis, arthritis, sciatic, gout, kidney nephritis, prostate problems, sinus, chronic constipation, and chronic cough.

(g) Can be used to improve the care and health of one's mouth, gums and teeth.

(h) Can be used to achieve and maintain good general health.

By employing the techniques of this invention, and gradually but surely develop one's knowledge of how to improve good general health by reading, digesting and applying the principles and techniques of the various references as organized by the health computer, one can develop better good general health with the resulting well being.

This invention allows one to gradually but surely develop one's general knowledge of how to care for one's health and the health of one's family, as the necessity arises by reading, digesting and applying the principles and techniques of the various references as organized by this invention. To program and acquire one's own good general health and that of one's family, which is a family responsibility, by better nutritions is definitely within one's reach. The realization that the body, given the necessary vitamins and minerals, can rebuild the wear and tear of its elements and guard against viral or bacterial infection and even the too often necessity of medical intervention will be gratifying and reassuring.

BRIEF DESCRIPTION OF THE DRAWINGS

The preferred embodiment of this invention is described in the drawings wherein.

DETAILED DESCRIPTION OF THE INVENTION

Figure 1:
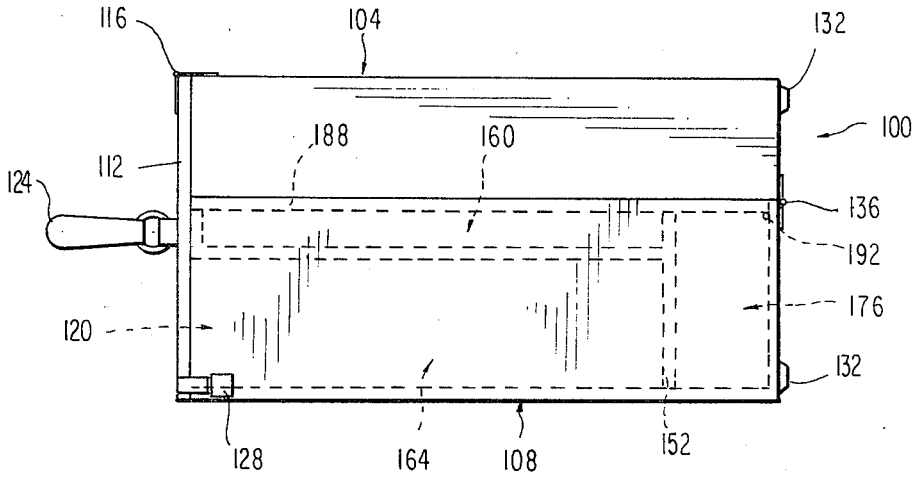
FIG. 1 is a side view of the portable case of this invention in the closed position.

Referring to FIG. 1, manually-portable case 100 is similar in outside construction to a conventional brief case. Case 100 has top housing 104 and bottom housing 108. Front cover (lid) 112 is hinged (at 116) to the top front edge of top housing 104. Front cover 112 overlaps and covers aperture or opening 120 in the front of bottom housing 108. Carrying handle 124 is located on top of front cover 112. Front cover 112 is held in place by conventional snap latches 128 mounted on the side of bottom housing 108. Nobs 132 are mounted on back wall of top housing 104 and bottom housing 108. Top housing 104 is hinged to bottom housing 108 by hinge 136.

Figure 2:
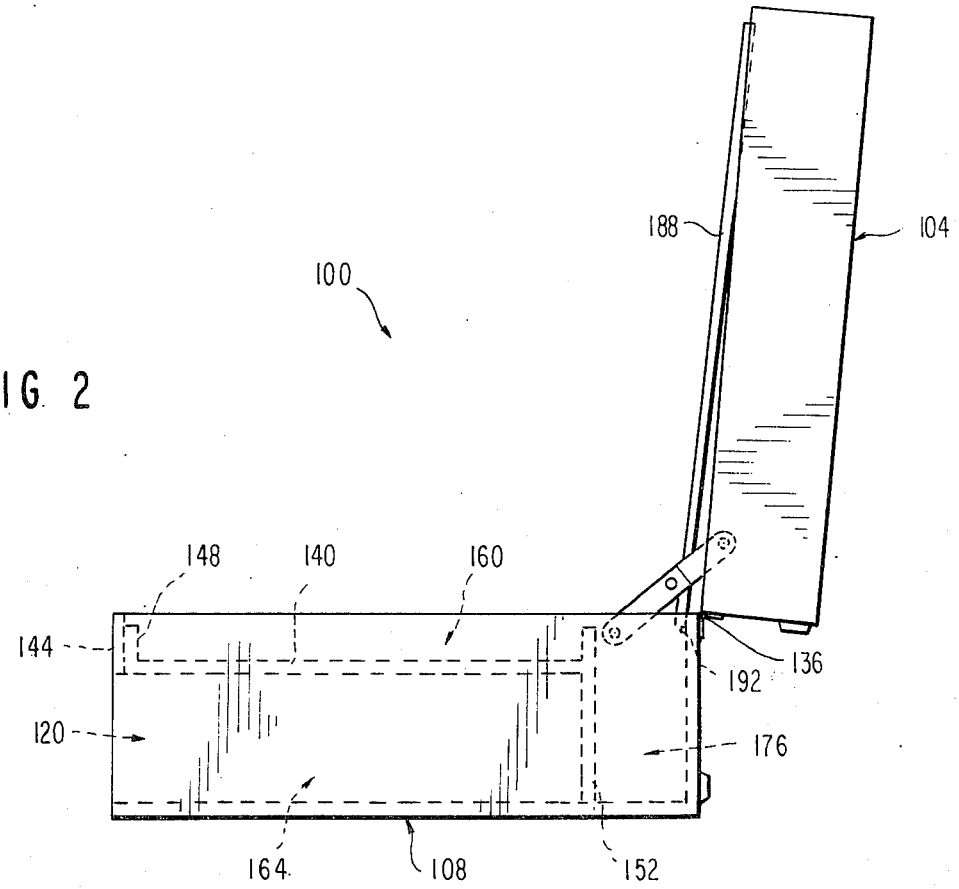
FIG. 2 is a side view of the portable case of this invention in the open position.
Figure 3:
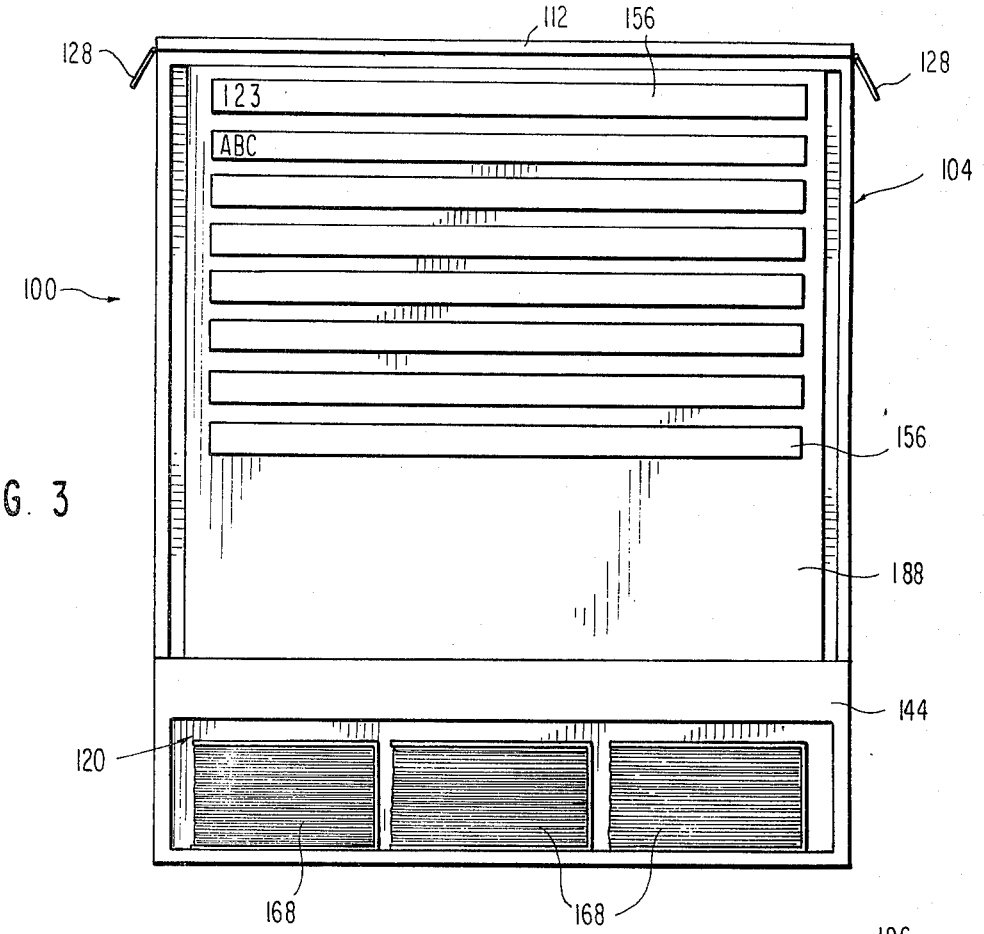
FIG. 3 is a front view of the portable case of this invention in the open position.
Figure 4:
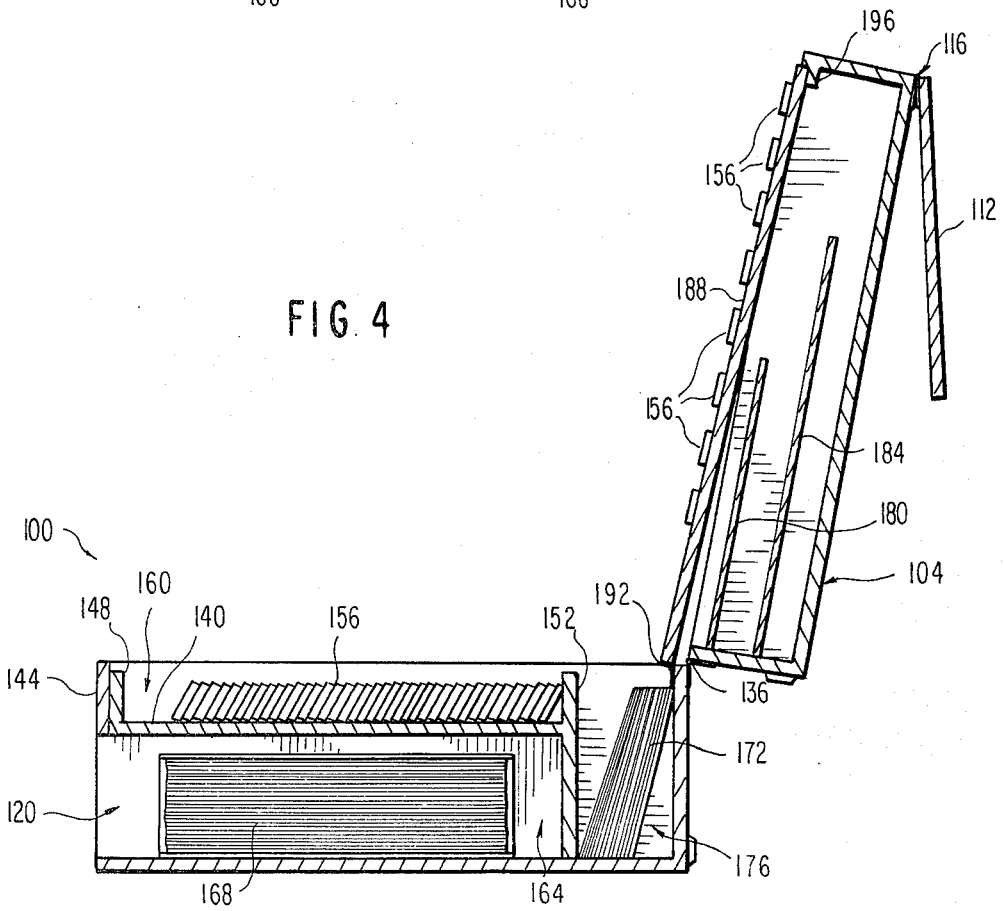
FIG. 4 is a cross-sectional view from the side of the portable case of this invention in the open position.

Bottom housing 108 contains horizontal wall 140 which is located above the top of aperture 120 and affixed to front wall 144 by means of vertical lip 148 (see FIG. 4). Horizontal wall 140 is affixed to vertical wall 152, thereby forming tray 160 for storing metal strips 156 and forming space 164 for storing book 168 (three in number in FIG. 3). Vertical wall 152 forms space 176 for storing cards 172. Top housing 104 contains dividers 180 and 184 to form compartments in which papers and pamphlets can be stored. Internal lid 188 is hinged at 192 on the inside of bottom housing 108. As shown in FIG. 1, lid 188 cover tray 160 when case 100 is in the closed position. As shown in FIG. 2, lid 188 can be raised to a nearly vertical position when case 100 is in the open position. See stop 196. Lid 188 can also be held upright in place by a snap located on a short strap affixed to top housing 104. Lid 188 is magnetized, so that metal strips 156 can be removably affixed to the surface of lid 188 in a display manner.

Brief case 100 has adequate space to house the indexing mechanism of the health program of this invention. Storage area 164 provides storage for the three noted publications for the prevention, alleviation and possible cure of common diseases. Other references or updated reference can be used. Storage area 176 immediately behind filing tray 160 stores and displays index card system 172 showing the various common diseases, the reference to the prevention publications, the symptoms which will aid diagnosis and the nutrients for the prevention and possible cure of such diseases. Index card system 172 also shows first aid for certain health hazards when applicable and index card system 172 further shows recipes of nutritious and congenial family menus.

Long metal strips 156 are filed alphabetically as follows: metal strips 156 by age and sex group showing nutrients required to maintain the good general health of persons in good health; metal strips 156 for various foods eaten each meal showing the nutrients reasonably expected in each foods; metal strips 156 showing well balanced formulas of vitamins and minerals supplements; metal strips 156 of various common disease showing the nutrients required for the prevention and the possible cure of such diseases; metal strips 156 showing certain life styles which are detrimental to good general health if not eliminated; and metal strips bars 156 showing certain life styles which induce good general health.

FIGS. 3 and 4 show hinged display lid 188 having the appropriate magnetic field for affixing various metal strips 156 obtained from the general files in order to construct a daily picture story, if desired, of the nutrients provided through the consumption of foods or through supplements, if necessary, to meet the requirements for good general health. Metal strips 156 for age and sex group showing the nutrients required to maintain the general good health of persons in good health are always affixed to display frame 188. Metal strips 156 for various foods eaten each meal showing the nutrients reasonably expected in such foods are refiled at the start of each day. The composition of a known congenial and nutritious meal may be copied on the formates provided and retained for ready planned future use. Metal strips 156 showing the nutrients of well balanced formulas of vitamins and minerals supplements are always affixed to display frame 188. Metal strips 156 for various common diseases showing the nutrients required for the prevention and possible cure of such diseases are only affixed when the symptoms of diseases or actual illness exist. Metal strips 156 indicating certain life style which are detrimental to good general health, if not eliminated, and the metal strips indicating certain life style which will induce good general health are always affixed to display frame 188.

Top housing 104 typically forms a general file section (e.g., 184 and 188) containing the following: a file space for each member of the family for filing individual medical history including their own personal analysis derived by knowing their own body plus all other pertinent professional medical documentation including the names of the current practicing physician, dentists, their address and telephone numbers and other hospital or emergency telephone numbers; a file containing numerous formats for copying good nutritious family recipes for quick review and selection of planned meals to prevent some troublesome inadequate last minute decisions; and any other file associated with the health of the family.

Table I below shows the content of several typical cards from the Index Card System For Common Diseases for use in this invention. Table II below shows the content of typical metal strips 156. Table III below shows a typical format set out on lid 188 using typical metal strips 156.

TABLE 1

| | CHAPTER | |
|---|---|---|
| **HEADACHES, Migraine** | | |
| 1. Symptoms: Vomiting, nausea, altered hearing and visual distortions such as light flashes or dark spots, speech difficulties and a general clamminess of the skin. | 175 | ENCY<br>VB<br>MB |
| 2. Again, the chances that nutrition may help are good for most patients. | | |
| 3. Consumption of foods providing B-Complex especially B3 Naicin. Replenish intestinal flora with yogurt or buttermilk. Breakfast should be a high protein, low fat, medium carbohydrate and consideration should be paid to the possibility of allergenic reactions. | | |
| **GALLSTONES** | | |
| 1. An estimated 16 million Americans are affected with gallstones, so you are not alone. Surgery is not always the best answer. | 164<br>56<br>17 | ENCY<br>VB<br>MB |
| 2. Symptoms: Some formation in the gallbladder and pain said to be worse than childbirth is followed by vomiting, jaundice and gallbladder inflamation. | | |
| 3. Maintain good general health with stress on lecithin, vitamin C and brand. | | |
| 4. Eliminate spinach, rhubarb and chocolate since they form oxalic acid Chapter 56 VB. Watch for fluoridated water Chapter 17MB. | | |

NOTES:
(1) ENCY is The Encyclopedia Of Common Diseases, Staff of Prevention Magazine, Rodale Press, (1982).
(2) VB is The Complete Book Of Vitamins, Staff Of Prevention Magazine, Rodale Press, (1977).
(3) MB is The Complete Book Of Minerals For Health, Sharon Faelton et al., Rodale Press, (1981).

TABLE II

| | | | | | | | | | | | | | | | | | |
|---|---|---|---|---|---|---|---|---|---|---|---|---|---|---|---|---|---|
| CABBAGE, raw, common variety finely shredded or chopped 1 CUP | 90 | 92 | 20 | 1 | — | — | — | 5 | 44 | 26 | .4 | 210 | 120 | .05 | .05 | .3 | 42 |
| CARROTS, raw, without crowns and tips - grated 1 CUP | 110 | 88 | 46 | 1 | — | — | — | 11 | 41 | 40 | .8 | 375 | 12100 | .07 | .06 | .7 | 9 |

TABLE II-continued

| | | | | | | | | | | | | | | | | | |
|---|---|---|---|---|---|---|---|---|---|---|---|---|---|---|---|---|---|
| CELERY, pascal type, raw stalk, large outer, 8 × 1½ in. 1 STALK | 40 | 94 | 5 | Trace | — | — | — | 2 | 16 | 11 | .1 | 136 | 110 | .01 | .01 | .1 | 4 |
| CAULIFLOWER, cooked drained from raw 1 CUP | 125 | 93 | 30 | 3 | — | — | — | 5 | 26 | 53 | .9 | 258 | 80 | .11 | .10 | .8 | 69 |
| COLLARDS, cooked, drained from raw (leaves without stems) 1 CUP | 190 | 90 | 65 | 7 | — | — | — | 10 | 357 | 99 | 1.5 | 498 | 14820 | .21 | .38 | 2.3 | 144 |

TABLE III

| Line No. | | AGE FR | AGE TO | WEIGHT | HEIGHT | PRODUCE WEIGHT GM | WATER % | CALORIES | PROTEIN GM | SATURATED GM |
|---|---|---|---|---|---|---|---|---|---|---|
| 1 | Children | 4 | 6 | 44 lb 20 kg | 44 in 112 cm | | | 1700 | 30 | |
| 2 | Males | 23 | 50 | 154 lb 70 kg | 70 in 178 cm | | | 2700 | 56 | |
| 3 | Females | 23 | 50 | 120 lb 55 kg | 64 in 163 cm | | | 2000 | 44 | |
| 4 | Ocean Perch Breaded, fried 1 FILLET | | | | | 85 | 59 | 195 | 16 | 2.7 |
| 5 | Potatoes, mashed, prepared from raw, milk and butter added 1 CUP | | | | | 210 | 80 | 195 | 4 | 5.6 |
| 6 | Broccoli, cooked, drained from raw, stalk, medium size 1 STALK | | | | | 180 | 91 | 45 | 6 | — |
| 7 | Apple, raw unpeeled (about 3 per lb without cores) 1 APPLE | | | | | 138 | 84 | 80 | Trace | — |
| 8 | Cheese, natural Camembert (3 wedges per 4 OZ Container) - 1 WEDGE | | | | | 38 | 52 | 115 | 8 | 5.8 |
| 9 | Milk, fluid whole (3.3% fat) 1 CUP | | | | | 244 | 88 | 150 | 8 | 5.1 |
| 10 | Bread, white - 1 SLICE | | | | | 25 | 36 | 70 | 2 | .2 |
| | LUNCH | | | | | | | | | |
| 11 | Spaghetti, enriched with meat balls and tomato sauce from home recipe - 1 CUP | | | | | 248 | 70 | 330 | 19 | 3.3 |
| 12 | Lettuce, raw, vutterhead, as Boston type head, 5 in. diam 1 HEAD | | | | | 220 | 95 | 25 | 2 | — |
| 13 | Cheese, natural cheddar 1 OZ | | | | | 28 | 37 | 115 | 7 | 6.1 |
| 14 | Pie, crust enriched and veg. shortening 9 in. diam 1 SECTOR - APPLE | | | | | 135 | 48 | 345 | 3 | 3.9 |
| 15 | Bread, Italian - 1 SLICE | | | | | 30 | 32 | 85 | 3 | Trace |
| | BREAKFAST | | | | | | | | | |
| 16 | Oatmeal or rolled oats 1 CUP | | | | | 240 | 80 | 130 | 5 | .4 |
| 17 | Milk, fluid whole (3.3% fat) 1 CUP | | | | | 244 | 88 | 150 | 8 | 5.1 |
| 18 | Banana, without peel (about 2.6 per lb with peel) 1 BANANA | | | | | 199 | 76 | 100 | 1 | — |

HIGH BLOOD PRESSURE PREVENTION 6 each

| Line No. | | AGE FR | AGE TO | WEIGHT | HEIGHT | OLEIC GM | LINOLEIC GM | CARBOHYDRATE GM | CALCIUM* MG | PHOSPHORUS MG |
|---|---|---|---|---|---|---|---|---|---|---|
| 1 | Children | 4 | 6 | 44 lb 20 kg | 44 in 112 cm | | | | 800 | 800 |
| 2 | Males | 23 | 50 | 154 lb 70 kg | 70 in 178 cm | | | | 800 | 800 |
| 3 | Females | 23 | 50 | 120 lb 55 kg | 64 in 163 cm | | | | 800 | 800 |
| 4 | Ocean Perch Breaded, fried 1 FILLET | | | | | 4.4 | 2.3 | 6 | 28 | 192 |
| 5 | Potatoes, mashed, prepared from raw, milk and butter added 1 CUP | | | | | 2.3 | .2 | 26 | 50 | 101 |

TABLE III-continued

| | | | | | |
|---|---|---|---|---|---|
| 6 Broccoli, cooked, drained from raw, stalk, medium size 1 STALK | — | — | 8 | 158 | 112 |
| 7 Apple, raw unpeeled (about 3 per lb without cores) 1 APPLE | — | — | 20 | 10 | 14 |
| 8 Cheese, natural Camembert (3 wedges per 4 OZ Container) - 1 WEDGE | 2.2 | .2 | Trace | 147 | 132 |
| 9 Milk, fluid whole (3.3% fat) 1 CUP | 2.1 | .2 | 11 | 291 | 228 |
| 10 Bread, white - 1 SLICE | .3 | .3 | 13 | 21 | 24 |
| LUNCH | | | | | |
| 11 Spaghetti, enriched with meat balls and tomato sauce from home recipe - 1 CUP | 6.3 | .2 | 39 | 124 | 236 |
| 12 Lettuce, raw, vutterhead, as Boston type head, 5 in. diam 1 HEAD | — | — | 4 | 57 | 42 |
| 13 Cheese, natural cheddar 1 OZ | 2.1 | .2 | Trace | 204 | 145 |
| 14 Pie, crust enriched and veg. shortening 9 in. diam 1 SECTOR - APPLE | 6.4 | 3.6 | 51 | 11 | 30 |
| 15 Bread, Italian - 1 SLICE | | .1 | 17 | 5 | 23 |
| BREAKFAST | | | | | |
| 16 Oatmeal or rolled oats 1 CUP | .8 | .9 | 23 | 22 | 137 |
| 17 Milk, fluid whole (3.3% fat) 1 CUP | 2.1 | .2 | 11 | 291 | 228 |
| 18 Banana, without peel (about 2.6 per lb with peel) 1 BANANA | — | — | 26 | 10 | 31 |
| HIGH BLOOD PRESSURE | | | | 1000 | 800 |
| PREVENTION 6 each | | | | 800 | 400 |

| Line No. | | AGE FR TO | WEIGHT | HEIGHT | IRON MG | POTASSIUM MG | A* FAT SOLUABLE IU | B1* THIAMIN MG | B2* RIBOFLAVIN MG |
|---|---|---|---|---|---|---|---|---|---|
| 1 | Children | 4 6 | 44 lb 20 kg | 44 in 112 cm | 10 | | 2500 | .9 | 1.0 |
| 2 | Males | 23 50 | 154 lb 70 kg | 70 in 178 cm | 10 | | 5000 | 1.4 | 1.6 |
| 3 | Females | 23 50 | 120 lb 55 kg | 64 in 163 cm | 18 | | 4000 | 1.0 | 1.2 |
| 4 | Ocean Perch Breaded, fried 1 FILLET | | | | 1.1 | 192 | — | .10 | .10 |
| 5 | Potatoes, mashed, prepared from raw, milk and butter added 1 CUP | | | | .8 | 525 | 360 | .17 | .11 |
| 6 | Broccoli, cooked, drained from raw, stalk, medium size 1 STALK | | | | 1.4 | 481 | 4500 | .16 | .36 |
| 7 | Apple, raw unpeeled (about 3 per lb without cores) 1 APPLE | | | | .4 | 152 | 120 | .4 | .3 |
| 8 | Cheese, natural Camembert (3 wedges per 4 OZ Container) - 1 WEDGE | | | | .1 | 71 | 350 | .01 | .19 |
| 9 | Milk, fluid whole (3.3% fat) 1 CUP | | | | .1 | 370 | 310 | .09 | .40 |
| 10 | Bread, white - 1 SLICE | | | | .6 | 26 | Trace | .10 | .06 |
| | LUNCH | | | | | | | | |
| 11 | Spaghetti, enriched with meat balls and tomato sauce from home recipe - 1 CUP | | | | 3.7 | 665 | 1590 | .25 | .30 |
| 12 | Lettuce, raw, vutterhead, as Boston type head, 5 in. diam 1 HEAD | | | | 3.3 | 430 | 1580 | .10 | .10 |
| 13 | Cheese, natural cheddar 1 OZ | | | | .2 | 28 | 300 | .01 | .11 |
| 14 | Pie, crust enriched and veg. shortening 9 in. diam 1 - APPLE | | | | .9 | 108 | 40 | .15 | .11 |

TABLE III-continued

| | | | | | |
|---|---|---|---|---|---|
| 15 Bread, Italian - 1 SLICE | .7 | 22 | 0 | .12 | .17 |
| BREAKFAST | | | | | |
| 16 Oatmeal or rolled oats 1 CUP | 1.4 | 146 | 0 | .19 | .05 |
| 17 Milk, fluid whole (3.3% fat) 1 CUP | .1 | 370 | 310 | .09 | .40 |
| 18 Banana, without peel (about 2.6 per lb with peel) 1 BANANA | .8 | 440 | 230 | .06 | .07 |
| HIGH BLOOD PRESSURE | | 100 | 25000 | 60 | 60 |
| PREVENTION 6 each | 30 | 40 | 10000 | 25 | 25 |

| Line No. | | AGE FR | TO | WEIGHT | HEIGHT | B3 MIACIN MG | C ASCORBIC ACID MG |
|---|---|---|---|---|---|---|---|
| 1 | Children | 4 | 6 | 44 lb 20 kg | 44 in 112 cm | 11 | 45 |
| 2 | Males | 23 | 50 | 154 lb 70 kg | 70 in 178 cm | 18 | 60 |
| 3 | Females | 23 | 50 | 120 lb 55 kg | 64 in 163 cm | 13 | 60 |
| 4 | Ocean Perch Breaded, fried 1 FILLET | | | | | 1.6 | — |
| 5 | Potatoes, mashed, prepared from raw, milk and butter added 1 CUP | | | | | 2.1 | 19 |
| 6 | Broccoli, cooked, drained from raw, stalk, medium size 1 STALK | | | | | 1.4 | 162 |
| 7 | Apple, raw unpeeled (about 3 per lb without cores) 1 APPLE | | | | | .1 | 6 |
| 8 | Cheese, natural Camembert (3 wedges per 4 OZ Container) - 1 WEDGE | | | | | .2 | 0 |
| 9 | Milk, fluid whole (3.3% fat) 1 CUP | | | | | .2 | 2 |
| 10 | Bread, white - 1 SLICE | | | | | .8 | Trace |
| | LUNCH | | | | | | |
| 11 | Spaghetti, enriched with meat balls and tomato sauce from home recipe - 1 CUP | | | | | 4.0 | 22 |
| 12 | Lettuce, raw, vutterhead, as Boston type head, 5 in. diam 1 HEAD | | | | | .5 | 13 |
| 13 | Cheese, natural cheddar 1 OZ | | | | | Trace | 0 |
| 14 | Pie, crust enriched and veg. shortening 9 in. diam 1 SECTOR - APPLE | | | | | 1.3 | 2 |
| 15 | Bread, Italian - 1 SLICE | | | | | 1.8 | 0 |
| | BREAKFAST | | | | | | |
| 16 | Oatmeal or rolled oats 1 CUP | | | | | .2 | 0 |
| 17 | Milk, fluid whole (3.3% fat) 1 CUP | | | | | .2 | 2 |
| 18 | Banana, without peel (about 2.6 per lb with peel) 1 BANANA | | | | | .8 | 12 |
| | HIGH BLOOD PRESSURE | | | | | 30 | 1200 |
| | PREVENTION 6 each | | | | | 25 | 300 |

Notes:
(1) *means important for growing children.
(2) The above vitamins and minerals are representative of the essential or important vitamins and minerals. Other essential or important vitamins and minerals are: fiber, D*fat soluable, E*fat soluable, K* fat soluable, B5* pantothenic acid, B6 pyridoxine, B12*, *Biotin insotal, *Folic acid, *magnisum *zinc, iodine, sodium, selenium, lecithin, oil of evening primose, pumpkin seed oil.

To repeat, a filing tray is located immediately above the storage area of the three prevention publications to display the index card system showing common diseases, the index card system for first aid treatment when applicable, the index card system of nutritious family preferred menus, the metal strip for nutrition requirements by age and sex of persons in good health, the metal strips for various foods with nutrients normally expected in such foods, the metal strips for various common diseases showing nutrients required to promote good general health, the metal strip showing the nutrients supplied by well balanced formulas of vitamins and minerals supplements, the metal strip showing certain life styles which are detrimental to good general health, if not eliminated, and the metal strip showing certain life styles which induce good general health. There is a hinged display frame with appropriate magnetic fields for affixing the various metal strips required to compute good general health. The headings show various information, vitamins and minerals with growth items marked by a star to accommodate the mothers of growing children. The requirements of nutrients by age and sex for persons in good health. Next is the food consumed per meal showing nutrients reasonably expected in the individual foods. Next is a strip showing the nutrients in well balanced formulas of vitamins and minerals supplements. Next are the strips with the anticipated or known common diseases for each member of the family showing the nutrients required for the prevention and possible cure of such common diseases. Next are the metal strips showing certain life styles which are detrimental to good general health if not eliminated and the metal bars showing certain life styles which induce good general health. Of all the strips ever displayed on the frame only the ones showing foods consumed are returned to the file prior to the start of a new day. Any good family recipes may be copied on formats provided inside of the cover for retention and for future planned nutritious meals. A quick review of the formats can immediately provide ideas for a congenial nutritious meal for the entire family. A well developed nutritious selection of meals to select from may prevent some wasteful inadequate meal as a result of last minute decisions. The metal strips denoting a disease of one of the family are filed away only when the symptoms disappear or the cure is achieved.

What is claimed is:

1. Portable case for such things as a health program comprising:

(a) a bottom housing having a bottom a back wall, two side walls and a front wall, the front wall has an aperture in the lower part thereof sufficient in size to allow the insertion into or removal therefrom of at least one book from the interior of the bottom housing;

(b) a top housing having a top, a back wall, two side walls and a front wall, the bottom edge of the back wall of the top housing being hinged to the top edge of the back wall of the bottom housing, the front wall of the top housing being enlarged so that it cover the front portion of the top housing and at least the aperture of the bottom housing, and the top edge of the front wall of the top housing being hinged to the front edge of the top of the top housing so that the top housing can be raised to a nearly vertical position when the bottom housing is in a horizontal position;

(c) a vertical wall positioned crosswise in the back portion of the bottom housing, the vertical wall forming a compartment in the back portion of the bottom housing;

(d) a horizontal wall positioned in the front portion of the bottom housing and contacting vertical wall (c) and the front wall of the bottom housing so as to form a shallow tray in which elongated narrow metal strips can be stored; and (e) a flat lid which is hinged on its back edge to the top edge region of the back wall of the bottom housing of the bottom compartment, the flat lid covering the tray formed by horizontal wall (d) when in the down position and being in a nearly vertical position when in the raised position, the flat lid being magnetized so that metal items can be attached thereto for display or similar purposes.

2. Portable case as claimed in claim 1 wherein a handle is mounted on the outside surface of the front wall of the top housing.

3. Portable case as claimed in claim 1 wherein at least one latch is positioned on the front wall of the top housing to affix it to the bottom housing.

4. Portable case as claimed in claim 1 wherein one or more compartments are positioned in the top housing so that the compartments are in a vertical position when the top compartment is in the raised position.

5. Method of using the portable case of claim 1 for conducting a health program which includes a displaying mineral and vitamin information and data for daily health needs and/or disease prevention and/or alleviation purposes by placing the metal strips containing such data on magnetized lid (e).

* * * * *